United States Patent [19]

Smith

[11] Patent Number: 4,748,967

[45] Date of Patent: Jun. 7, 1988

[54] PORTABLE SPACE HEATER HAVING DISPOSABLE HEAT SOURCE

[76] Inventor: Edward J. Smith, 11- Bisset Dr., West Milford, N.J. 07480

[21] Appl. No.: 500,945

[22] Filed: Jun. 3, 1983

[51] Int. Cl.[4] ..... F24C 1/16

[52] U.S. Cl. ..... 126/59; 126/43; 126/93; 126/25 C

[58] Field of Search ..... 126/43, 47, 48, 59, 126/59.5, 90, 92, 93, 96, 97, 218, 262, 266, 204

[56] References Cited

U.S. PATENT DOCUMENTS

| | | | |
|---|---|---|---|
| 704,847 | 7/1902 | Matthey-Meier | 126/59.5 X |
| 1,129,714 | 2/1915 | Oaks | 126/266 |
| 1,435,521 | 11/1922 | Heimerl | 126/266 |
| 1,879,954 | 9/1932 | Smith | 126/43 |
| 2,227,251 | 12/1940 | Engh | 126/48 X |
| 2,756,738 | 7/1956 | Kratz | 126/43 X |
| 2,803,240 | 8/1957 | Howell | 126/43 X |
| 3,140,705 | 7/1964 | Dry | 126/93 |
| 4,351,314 | 9/1982 | Morton | 126/59 |

*Primary Examiner*—Margaret A. Focarino
*Attorney, Agent, or Firm*—Louis E. Marn

[57] ABSTRACT

There is disclosed a portable space heater comprised of a base member, a cylindrically-shaped chimney member including means for removably inserting a fuel source therein mounted on the base member and defining therebetween inlet means for combustion air and a substantially planar lid member mounted on said cylindrically-shaped chimney member and defining therebetween an outlet means for combustion gases.

3 Claims, 1 Drawing Sheet

PORTABLE SPACE HEATER HAVING DISPOSABLE HEAT SOURCE

FIELD OF INVENTION

The present invention relates to heaters, and more particularly to portable space heaters designed to provide heat to preselect locations; the space heater having an easily insertible, removable and disposable heat source.

BACKGROUND OF THE INVENTION

The rising costs in heating fuels has led to the design of a variety of inexpensive and efficient heating units. One particular field of endeavor has involved the development of portable space heaters. These are heating devices designed to heat a relatively small area for the convenience and comfort of individuals occupying the particular area for limited time periods.

A fireplace in a single room which radiates heat within the room is in effect, a space heater for that particular room as opposed to the overall dwelling. A pot-belly stove which radiates heat in a particular area can also be considered as a space heater for the area within which the heat radiates. The aforementioned two examples suffer from the drawback that they are not portable and once in location are committed to a particular area for heat radiation. Electronic and quartz space heaters have been developed which can be moved from position to position within a dwelling place and connected to an electrical outlet to provide heat in any desired location within the dwelling place. The development of electric space heaters has overcome the problem of portability associated with fireplaces and pot-bellied stoves, but the electronic space heaters also suffer from a drawback in that they can only be used where there is a source of electrical energy.

Therefore, there exists a need for an efficient space heater which is easily portable and which can be used both indoors and outdoors regardless of the presence of an electrical outlet and which uses an inexpensive fuel source. Portable types of space heaters have been disclosed, inter alia, in U.S. Pat. Nos. 208,251; 1,254,019; 1,879,954; 2,532,139 and 2,803,240.

OBJECTS OF THE INVENTION

An object of the present invention is to provide a novel portable space heater.

Another object of the present invention is to provide a novel portable space heater utilizing an inexpensive fuel source and independent of any electrical requirements.

A further object of the present invention is to provide a novel portable space heater with disposable fuel source capable of operation without any additional attachments or apparatus.

SUMMARY OF THE INVENTION

These and other objects of the present invention are achieved by a space heater comprised of a base member, a cylindrically-shaped chimney member including means for removably inserting a fuel source therein mounted on the base member and defining therebetween inlet means for combustion air and a substantially planer lid member mounted on said cylindrically-shaped chimney member and defining therebetween an outlet means for combustion gases.

BRIEF DESCRIPTION OF THE DRAWINGS

A better understanding of the present invention as well as other objects and advantages thereof will become apparent upon consideration of the detailed disclosure thereof especially when taken with the accompanying drawings wherein.

DETAILED DESCRIPTION OF THE DRAWINGS

Figure 1:
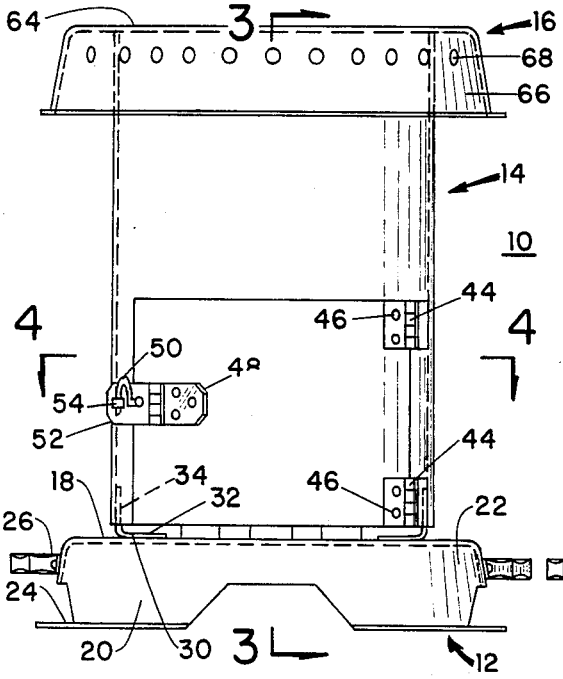
FIG. 1 is an elevational view of the space heater of the present invention.
Figure 2:
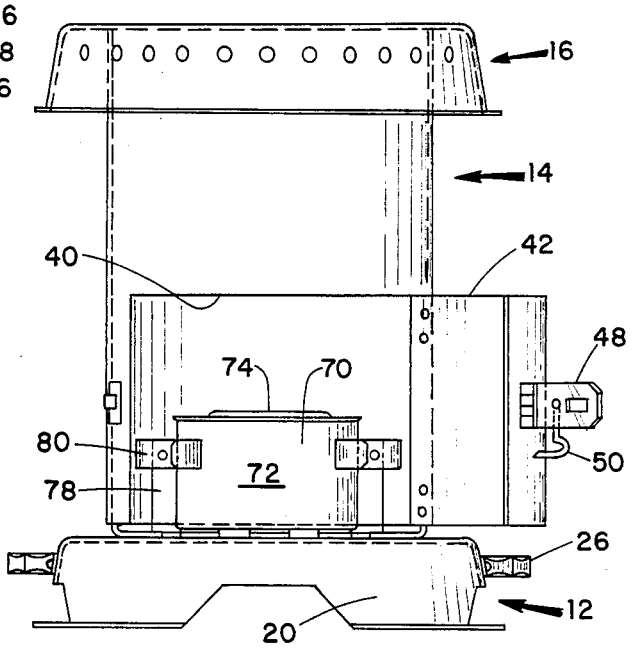
FIG. 2 is an elevational of the space heater of the present invention illustrating a fuel source positioned therein.

Referring now to the drawing and particularly FIGS. 1 and 2, there is shown an embodiment of the space heater of the present invention, generally designated as 10. The space heater 10 is comprised of a base member, a cylindrically-shaped member and a lid member, generally designated as 12, 14 and 16, respectively. The base portion 12, which in a preferred embodiment, is constructed of a single piece of material having a planar circular upper surface portion 18 and four leg segments 20 depending downwardly from the upper surface portion 18 thereby defining an annular sidewall 22. Secured to the base of each leg segment 20, there is mounted a planar flange member 24, extending outwardly in a horizontal plane to distance slightly greater than the diameter of upper planar circular surface 10. The planar flange members 24 provide stability to the space heater 10, as will be more fully described hereafter. Secured to the base member 12 on the annular sidewall 22 disposed 180° apart, are handles 26 permitting the movement and relocation of the space heater 10.

Figure 3:
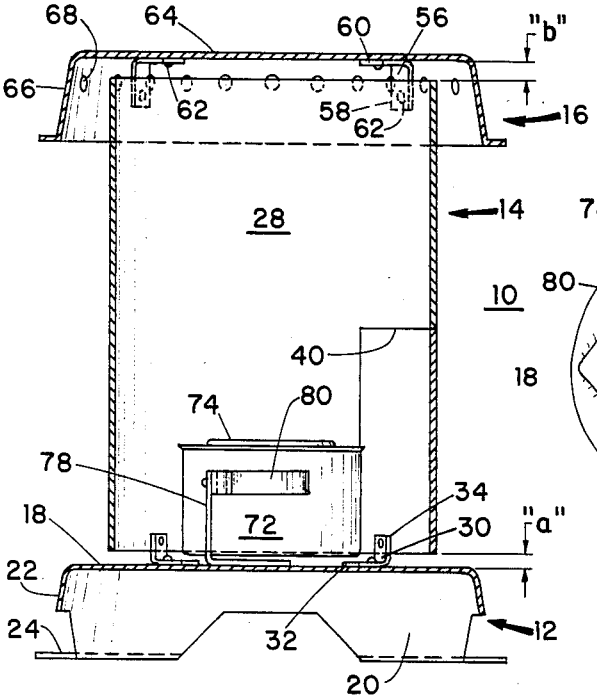
FIG. 3 is a cross-sectional view of the space heater taken along the line 3—3 of FIG. 1.

The cylindrically-shaped chimney member 14 defines a combustion chamber 28, referring to FIG. 3, and is vertically mounted to the base member 12 by means of a plurality L-shaped brackets 30 including a horizontal leg portion 32 and a vertical leg portion 34. As seen in FIG. 1 and in greater detail in FIG. 4, the horizontal leg portion 32 of each L-shaped bracket 30 is secured to the base member 12 by fastener means 36, such as a rivet or the like. The vertical leg portion 34 of the L-shaped brackets 30 is mounted to the cylindrically-shaped chimney member 14 by like fastener means 36.

In the embodiment of the present invention, four L-shaped brackets 30 are provided in securing cylindrically-shaped chimney member 14 to the base member 12 to provide vertical stability to the cylindrically-shaped chimney member 14. However, placement of the L-shaped brackets 30, so as to centrally locate the cylindrically-shaped member 14 on the planar circular surface 18 of the base member 12 must be given consideration as set forth hereafter, such that the fuel source can be easily removably inserted into the chamber 28.

The cylindrically-shaped chimeny member 14 is mounted to the base member 14 to provide an annular gap between a lower end portion 36 of the cylindrically-shaped chimeny member 14 and the planar circular surface 18 of the base member 12, referring particularly to FIG. 3.

The cylindrically-shaped chimney member 14 is formed with a semi-cylindrically-shaped open portion 40 enclosed by a closure or door member 42 mounted to the chimeny member 14 by upper and lower hinge member 44, mounted, such as by rivets 46 to the respective hinge members. The closure or door member 42 is provided with a locking device 48 including pivotably mounted latch member 50 mounted, such as by rivets 46 to the door member 42 opposite the upper and lower hinge members 44. A surface portion of the cylindrically-shaped chimney member 14 proximate the locking device 48 is provided with a cooperating locking device 52 including loop portion 54 for receiving in interlocking relationship the latch member 50 of the locking device 48 mounted on the closure or door member 42.

About a top end portion of the cylindrically-shaped chimney member 14, there are mounted a plurality of L-shaped brackets 56 including a vertical leg portion 58 and a horizontal leg portion 60, with the vertical leg portion 58 of each L-shaped bracket 56 mounted, such as by rivet 62, to the cylindrically-shaped chimney member 14. The horizontal leg portion 60 of each L-shaped brackets 56 extend inwardly towards the chamber 28 for mounting, such as by rivets 62, the substantially planar lid member 16, referring particularly to FIG. 3.

The lid member 16 is comprised of a planar top wall 64 from which downwardly depends an annular frusto-conically-shaped side wall 66 including a plurality of evenly spaced orifices 68. The lid member 16 is mounted to the cylindrically-shaped chimney member 14 a distance "b" between the top wall 64 of the lid member 16 and a top end portion of the cylindrically-shaped chimney member 14 thereby defining an annular outlet for combustion gases, as more fully hereinafter discussed. The distance "b" is greater than the distance "a", preferably a distance of between about 1.5 to 1 to 2 to 1 preferably 2 to 1. The orifices 68 formed in the side wall 66 of the lid member are preferably positioned below the top end portion of the cylindrically-shaped chimney member 14.

The closure or door member 42 provides means by which a disposal fuel element 70 is positioned within and removed from within the chamber 28 of the portable space heater 10. The disposable fuel element 70 is comprised of a cylindrically secure fuel reservoir 72 having an open top capable of being enclosed by a cover 74. The fuel reservoir 72, in a preferred embodiment of the present invention contains a solid, wax-like fuel such as "sterno". The disposal fuel element 70 is positioned within the chamber 28 formed by the cylindrically-shaped member 14 by means of cooperating spring tension jaw and mounting member 78 including jaw portion 80 secured to the top surface 18 of the base member 12. The jaws 80 are positioned apart a distance slightly less than the circumference of the disposal fuel container 70.

In operation, the portable space heater 10 is positioned within a preselect area to be heated. The door means 42 is hingeably rotated in a counterclockwise direction to access the chamber 28. A disposable fuel element 70, preferably after removal of any cover is positioned within the jaws 80 of the spring tension jaw and mounting member 78. The fuel in the fuel reservoir 72 is subjected to an elevated temperature for a time sufficient to raise the surface temperature of the fuel above the auto ignition temperature thereby to effect combustion of the fuel. The door member 42 is hingeably rotated in a clockwise direction to a point permitting the insertion of the latch member 50 of the locking device 48 within the loop 54 of the locking device 52. Since the distance "a" is less than the distance "b", a chimney effect is produced permitting effective flow of combustion supporting medium through the annular inlet defined by the base member 12 and the cylindrically-shaped member 14.

Figure 4:
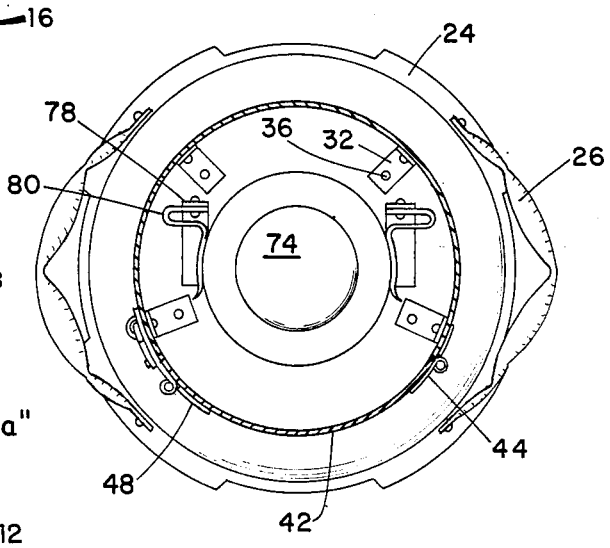
FIG. 4 is a cross-sectional top view of the space heater taken along the line 4—4 of FIG. 1.

As illustrated in FIG. 4, the portable space heater 10 of the present invention may be provided with a plurality of annular rings of various openings, illustrated by the concentric dotted lines, generally indicated as 80, referring particularly to FIG. 4, to be positioned within the fuel element 70 thereby permitting variance to the rate of combustion of the solid fuel.

Numerous moidifications and variations of the invention are possible in light of the above teachings and therefore the invention may be practiced otherwise than as particularly described.

What is claimed:

1. A portable space heater designed to heat a relatively small area for the convenience and comfort of individuals, which comprises:

a base member having a planar upper surface;

a vertically disposed, cylindrically-shaped chimney member defining a combustion chamber, said chimney member being fixedly attached to said base member to provide a circumferential gap forming a gaseous inlet means of a spacial distance "a" therebetween, said chimney member including an access door for the placement of disposable fuel elements within said combustion chamber;

a horizontally disposed lid member comprised of a planar top wall from which downwardly depends a frusto-conically shaped side wall, said horizontally disposed lid member being fixedly attached to an upper portion of chimney member to provide a circumferential gap forming a combustion gaseous outlet means of a spacial distance "b" therebetween, said spacial distance "b" being equal to about twice said distance "a";

a fuel reservoir for positioning disposable fuel elements within said combustion chamber through said access door; and retaining means secured to said base member and adapted to secure said fuel reservoir to said upper surface of said base member.

2. A portable space heater as defined in claim 1 wherein said frusto-conically shaped side wall of said lid member includes a plurality of orifices positioned below an upper end portion of said cylindrically-shaped chimney member.

3. A portable space heater as defined in claim 2 wherein variable orifice means is provided to said fuel reservoir for controlling the rate of combustion of said disposable fuel elements positioned within said fuel reservoir.

* * * * *